US005950446A

United States Patent [19]

Tromblee et al.

[11] Patent Number: 5,950,446

[45] Date of Patent: Sep. 14, 1999

[54] COMPACT AIR CONDITIONER

[75] Inventors: Jon D. Tromblee, Coloma; Nihat O. Cur, St. Joseph; Michael L. Huie, St. Joseph; Jeffery J. Anselmino, St. Joseph, all of Mich.

[73] Assignee: Whirlpool Corporation, Benton Harbor, Mich.

[21] Appl. No.: 09/164,465

[22] Filed: Oct. 1, 1998

[51] Int. Cl.[6] ..... F25D 23/12

[52] U.S. Cl. ..... 62/262; 165/122; 165/124

[58] Field of Search ..... 62/262, 428; 165/124, 165/122, DIG. 310, DIG. 316, DIG. 317

[56] References Cited

U.S. PATENT DOCUMENTS

| | | | |
|---|---|---|---|
| 2,115,288 | 4/1938 | Smith | 62/129 |
| 2,299,527 | 10/1942 | Cody et al. | 62/140 |
| 2,920,459 | 1/1960 | Ladusaw | 62/281 |
| 2,952,997 | 9/1960 | Mullin | 62/409 |
| 3,729,952 | 5/1973 | Macleod | 62/428 |
| 5,184,455 | 2/1993 | Matsumi | 62/262 |
| 5,685,166 | 11/1997 | Li | 62/428 |

FOREIGN PATENT DOCUMENTS

| | | |
|---|---|---|
| PCT/JP98/03103 | 10/1998 | WIPO . |

*Primary Examiner*—Henry Bennett
*Assistant Examiner*—Marc Norman
*Attorney, Agent, or Firm*—Hill & Simpson

[57] ABSTRACT

An ir conditioner is provided which includes a full-front evaporator and a U-shaped condenser. Separate air streams for the evaporator and condenser are provided by two axial flow fans driven by one motor. Evaporator air flow is drawn in axially and discharged radially through louvers in the top and both sides of the cabinet. Condenser air flow is drawn in through the sides of the U-shaped condenser and discharged through the rear of the U-shaped condenser.

31 Claims, 2 Drawing Sheets

COMPACT AIR CONDITIONER

BACKGROUND OF THE INVENTION

1. Field of the Invention

The present invention is directed to a room air conditioner and more particularly to a room air conditioner having an evaporator facing a room side of the air conditioner, a condenser on an outdoor side of the air conditioner and a dividing wall between the two, all enclosed within outer cabinetry of the air conditioner.

Room air conditioners generally have an air inlet and an air outlet at a front side of the air conditioner which faces the interior of the room when the air conditioner is positioned in a window opening or in a through-the-wall sleeve. Usually warm air is drawn in through a portion of the front panel to pass through an evaporator coil to be cooled and then is directed by a blower or fan to an outlet or outlets, also in the front panel. The outlet may be a single opening positioned either along a top or bottom edge of the front panel or may be a single opening positioned at one lateral side or the other of the front panel. Occasionally the air from the blower is directed into a manifold type box or plenum chamber and from that chamber it is allowed to exit through the front of the air conditioner through more than one opening. For example, in U.S. Pat. No. 3,472,149, assigned to the assignee of the present invention, air is drawn into the air conditioner unit through a lower front grill portion and is redelivered to the room through a grill portion which extends along the top edge of the air conditioner.

In U.S. Pat. No. 2,737,788, air is drawn in from a front lower grill opening, through a filter and the air is pressurized by a fan mounted in a manifold chamber or plenum from which air is permitted to exit through two spaced grills. In U.S. Pat. No. 4,492,094, air is drawn in through a front grill, is pressurized by a fan and exits through a grill 30 located at a bottom edge of the front panel. In U.S. Pat. No. 5,065,596, air is drawn in through a central portion of the front panel, is pressurized by a fan and is directed into a plenum chamber to exit from two spaced lateral air outlets through the front panel of the air conditioner.

In each of these arrangements, the evaporator coil extends only across a portion of the lateral width and/or vertical height of the front panel, thus requiring the evaporator to be doubled over (multi-layer) so as to provide a sufficient surface area for the heat exchange between the refrigerant within the evaporator and the air stream flowing past the evaporator to occur. As a result, excess fan power is required to overcome the pressure drop created across multiple layer evaporators.

In most room air conditioners, the condenser coil is positioned along a rear wall of the air conditioner unit and ambient air is caused to flow across the condenser by means of a fan. In order to provide a sufficient amount of surface area for heat exchange between the ambient air and the condenser, the condenser must be relatively thick. As a result, the condenser, like the multiple layer evaporator discussed above, consumes substantial amounts of space in the air conditioner unit and requires extra fan power to overcome a substantial air flow pressure drop. Typically there are air openings formed in side walls of an outer cabinet for the air conditioner to provide for the air stream which flows across the condenser.

Typically the use of a manifold plenum chamber or similar structure requires an extra space in the air conditioner thereby reducing the compactness of the air conditioner and adding to the bulkiness of the air conditioner.

Also, such a structure requires extra parts and weight, thus increasing the costs and complexity of manufacturing.

SUMMARY OF THE INVENTION

An improved air conditioner configuration and construction which solves the aforenoted problems is provided which utilizes a flat evaporator that extends substantially across the entire width and height of the front of the air conditioner, and a U-shaped condenser that extends the full height along the rear outside portion of both sides and across the entire rear face of the air conditioner. The evaporator and condenser are separated by an insulated divider wall with the evaporator in front of the divider wall inside the room and the condenser behind the divider wall outside the room. The evaporator, divider wall, and condenser are mounted on a base. A compressor is also mounted on the base behind the divider wall within the U-shaped condenser. An interior cabinet attached to the base and divider wall surrounds the evaporator. A front grill and filter attached to the interior cabinet cover the front of the evaporator. An exterior top attached to the base and divider wall covers the condenser and compressor. Optionally, a lightweight open grill is inserted between the exterior top cover and the base to protect the outside of the U-shaped condenser.

A first air stream is provided in front of the divider wall inside the room by a fan positioned within an orifice in a plate located between the evaporator and the divider wall. The orifice plate connects with the evaporator through a foam shroud. The fan is driven by a motor mounted on the back of the divider wall. The evaporator, shroud, orifice plate and divider wall are surrounded by the base and interior cabinet to define fan inlet and outlet air flow paths. The fan draws room air axially in through the front face of the air conditioner across the evaporator, and discharges the cooled air radially outward back into the room through integral louvers located in the top and both side walls of the interior cabinet between the orifice plate and the divider wall. The user benefits from the radial discharge design because it provides even, draft-free cooling through the wide angular distribution of air at relatively low velocity. Alternately, room air may be drawn radially in through louvers in the top wall and side walls of the air conditioner forward of the divider wall, pulled across the evaporator, and discharged axially back into the room through the front of the air conditioner. In either evaporator air flow configuration, because the air flow area is maximized and its turning angle is reduced from 180 degrees to 90 degrees, the user benefits from significantly reduced fan power and noise.

A second air stream is provided behind the divider wall outside the room by a fan positioned within an orifice in a plate located between the divider wall and the rear of the condenser. The fan is driven by the same motor mounted on the back of the divider wall that drives the evaporator fan. The orifice plate connects with the condenser, base and exterior top cover to define fan inlet and outlet air flow paths. The fan draws outside air inward through the sides of the U-shaped condenser and discharges the air backward through the rear of the U-shaped condenser. Additional air may be drawn inward through openings provided in the exterior top cover, the base or the partial side walls behind the divider wall. Alternately outside air may be drawn inward through the rear of the U-shaped condenser and discharged outward through the sides of the U-shaped condenser. The benefits of the U-shaped condenser are that one fan motor can be used to drive both evaporator and condenser fans, the amount of material in the surrounding cabinet is reduced because the condenser forms a large portion of the side walls, and the outside appearance is improved because the interior of the unit is completely hidden from view unlike conventional units.

Optionally, this design also allows additional cooler outdoor ambient air to be brought in after the major portion of the condenser air flow goes through the initial portion of the U-shaped condenser on the side walls. The cooler, secondary condenser air stream admitted from the top may also wash the compressor first to cool the compressor and then combine with one primary condenser air flow coming from the initial portion of the condenser. The combined air flow is then directed through the fan to the second portion of the condenser on the back wall of the air conditioner for more effective heat exchange.

In an embodiment, the evaporator fan orifice plate is integrally part of the interior cabinet.

In an embodiment, the U-shaped condenser is mounted on the base so that it extends up both sides and across the top of the air conditioner. The condenser covers the compressor and extends from the divider wall to the condenser fan orifice plate which forms the back wall of the unit. The condenser fan orifice plate and the divider wall are integrally part of the base.

In an embodiment, the evaporator extends across the entire width and height of the front of the unit, and the unit is operated by a remote control communicating through a sensor located on the front grill.

In an embodiment, the evaporator extends across the entire width and height of the front of the unit, and the unit is operated by electro mechanical controls. The control elements are mounted on the back of the divider wall with rotary shafts extending forward through the evaporator and front grill. Knobs mounted on the shafts at the front grill allow the user to operate the controls.

In an embodiment, the evaporator extends across the entire width and most of the height of the front of the unit. Controls are mounted above the evaporator.

In an embodiment, air is discharged back into the room through louvers located in the base as well as through louvers located in the top and both side walls of the interior cabinet.

Other objects and advantages of the present invention will become apparent upon reading the following detailed description and appended claims, and upon reference to the accompanying drawings.

It should be understood that the drawings are not necessarily to scale and that the embodiments are sometimes illustrated by graphic symbols, phantom lines, diagrammatic representations in fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PREFERRED EMBODIMENTS

Figure 1:
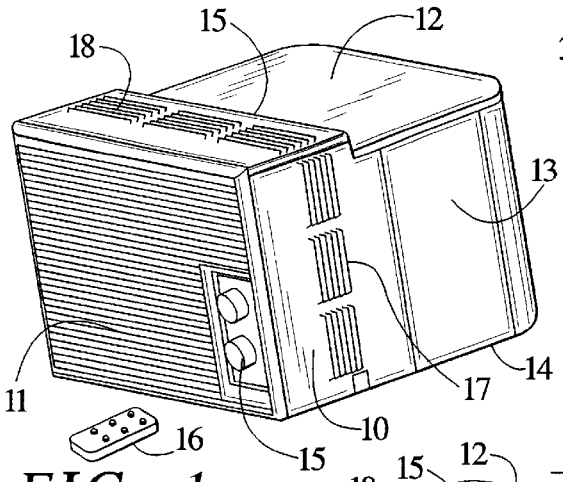
FIG. 1 is a perspective view of a room air conditioner embodying the principles of the present invention.
Figure 3:
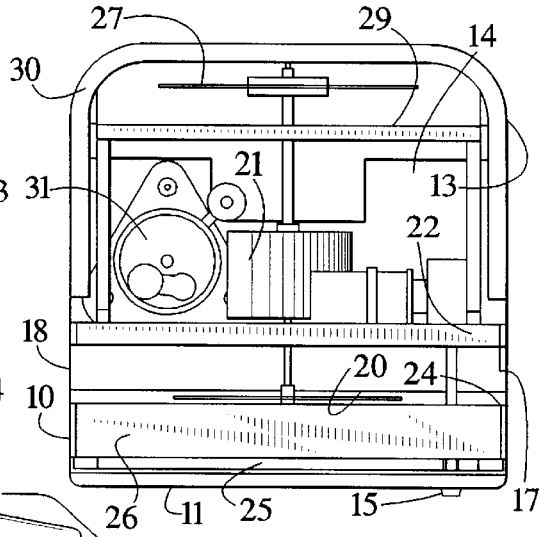
FIG. 3 is a partial top sectional view of the room air conditioner of FIG. 1.

In FIG. 1, an air conditioner includes an interior cabinet 10 with an attached front grill 11, an exterior top 12, and a protective grill 13, all mounted on a base 14. The air conditioner is operated by a control panel 15 located on the front grill 11. The air conditioner may also be operated by a remote control 16 using suitable signal means. Room air is pulled into the front grill 11 and discharged radially back into the room through louvers 17, 18 and 19 located on the interior cabinet 10.

Figure 2:
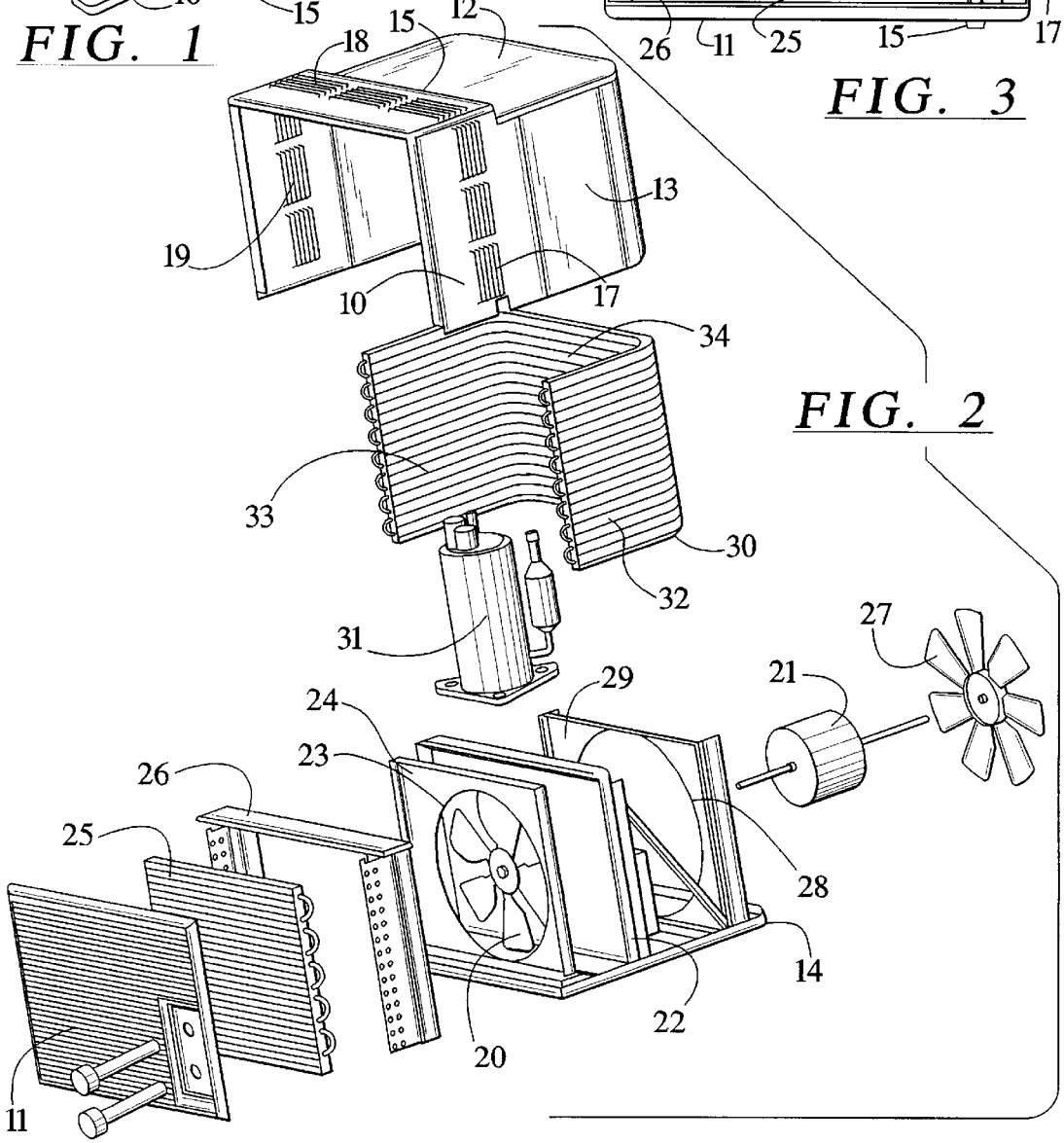
FIG. 2 is an exploded view of the principle components of the room air conditioner of FIG. 1.

In FIG. 2, a fan 20 driven by a fan motor 21 mounted to a divider wall 22 is placed in an orifice 23 located in a plate 24. The orifice plate 24 is connected to the evaporator 25 by a shroud 26. The evaporator 25, shroud 26, orifice plate 24 and divider wall 22 sit on the base 14 and are surrounded by the interior cabinet 10. The front grill 11 attached to the interior cabinet 10 protects the evaporator and improves the appearance of the unit. This arrangement of parts defines distinct inlet and outlet paths for air flowing through the fan 20. The fan 20 pulls room air axially in through the front grill 11 and across the evaporator 25. The cooled air after passing through the fan 20 in the orifice 23 impinges on the divider wall 22 and is turned 90 degrees from the axis of the fan 20 to flow radially outward back into the room through louvers 17, 18 and 19 located in the interior cabinet 10 surrounding the space between the orifice plate 24 and the divider wall 22. It is also possible, although not shown here, to provide louvers in the base 14 in the space between the orifice plate 24 and the divider wall 22 which would allow cooled air to be discharged down into the room.

In an alternate configuration, the evaporator air flow is reversed. Room air is pulled in through louvers 17, 18 and 19 in the interior cabinet 10 by the fan 20. The air passes through the fan 20 and is pushed through the evaporator 25 back to the room through the front grill 11.

In an alternate configuration, the shroud 26 and the orifice plate 24 are integrally part of the interior cabinet 10 and made from the same piece of material.

Because the evaporator 25 extends across the entire width and height of the front opening of the interior cabinet, the number of tube rows required in the evaporator 25 to achieve adequate heat transfer surface is minimized which reduces the air flow pressure drop across the evaporator 25. Turning the air flow only 90 degrees at the divider wall 22 to discharge it back into the room reduces the discharge air flow pressure drop. Locating the discharge louvers 17, 18 and 19 in the top and sides of the interior cabinet 10 allows more area for the discharge air flow which reduces its velocity and the discharge air flow pressure drop. The combined reduction in air flow pressure drop throughout the entire air flow path reduces the evaporator fan power requirement which is a benefit to the user. The reduction in both the fan power and the air flow discharge velocity significantly reduce the noise level of the unit which is another important benefit to the user.

In FIG. 2, the fan 27 driven by the motor 21 mounted on the divider wall 22 is placed in an orifice 28 located in a plate 29. The sides of the orifice plate 29 connects to the condenser 30, and both are attached to the base 14. The condenser 30 is also attached to the divider wall 22. The compressor 31 is mounted on the base 14 within the condenser 30. The exterior top cover 12 sits on top of the condenser 30 covering the compressor 31 and is attached to the divider wall 22 and the orifice plate 29. Optionally, the exterior top cover 12 may have a step 15 as shown to allow for easy installation on the window, though it is not necessary. The protective grill 13 surrounds the outside of the condenser 30 and is captured between the base 14 and the exterior top cover 12. This arrangement of parts defines distinct inlet and outlet paths for air flowing through the fan 27. The fan 27 pulls outside air in through the protective grill 13 and through the sides 32 and 33 of the condenser 30. The air flows across the compressor 31 and the fan motor 21, providing cooling. Additional openings to enhance cooling of the compressor 31 and the fan motor 21 can be provided in the exterior top cover 12, the base 14 or in the rear side walls of the interior cabinet 10. After passing through the fan 27, the air is discharged through the back 34 of the condenser 30 and the protective grill 13.

In an alternate configuration, the condenser air flow is reversed. Outside air is pulled in through the back 34 of the condenser 30 by the fan 27. The air passes through the fan 27, flows over the compressor 31 and the fan motor 21 providing cooling, then discharged to the outside through the sides 32 and 33 of the condenser 30.

The U-shaped condenser configuration of the condenser 30 allows it to be systematically integrated with the base 14 and the divider wall 22 providing adequate strength and support with minimum material needed for the interior cabinet 10, the exterior top cover 12 and the protective grill 13, minimizing weight and cost. The U-shaped configuration of the condenser 30 in combination with the orifice plate 29 allows one fan motor 21 to drive both fans 20 and 27, reducing cost and complexity. The U-shaped configuration of the condenser 30, in combination with the protective grill 13, conceals and protects the internal working components of the unit, improving the exterior appearance and improving unit reliability.

Figure 4:
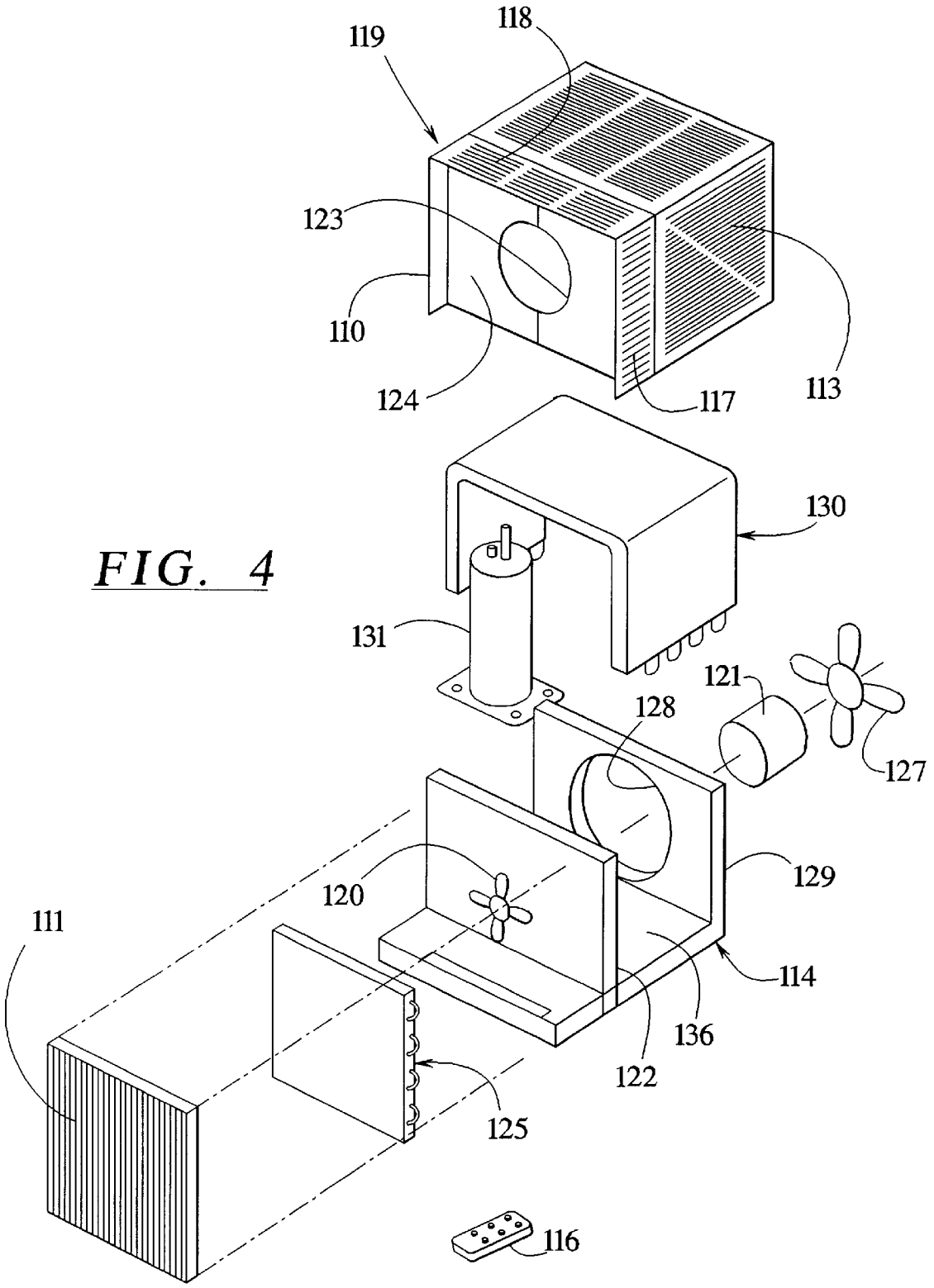
FIG. 4 is an exploded view of the principle components of an alternative embodiment of the air conditioner of the present invention.

FIG. 4 shows an alternative embodiment of the air condition of the present invention. Reference numerals preceded by a '1' are used to identify like or similar parts. the air conditioner includes a cabinet 110 with an attached front grill 111 mounted on a base 114. A protective 113 for the condenser 130 is integrally part of the cabinet 110. The air conditioner may also be operated by a remote control 116 using suitable signal means. Room air is pulled into the front grill 111 and discharged radially back into the room through louvers 117, 118 and 119 located in the front portion of the cabinet 110. A fan 120 driven by a fan motor 121 mounted to a divider wall 122 is placed in an orifice 123 located in a plate 124. The divider wall 122 is integrally part of the base 114, and the orifice plate 124 is integrally part of the cabinet 110. The evaporator 125 extends across the full height and width of the front of the cabinet 110 and is attached to the cabinet 110 ahead of the orifice plate 124. The front grill 111 attached to the cabinet 110 protects the evaporator and improves the appearance of the unit. This arrangement of parts defines distinct inlet and outlet paths for air flowing through the fan 120. The fan 120 pulls room air axially in through the front grill 111 and across the evaporator 125. The cooled air after passing through the fan 120 in the orifice 123 impinges on the divider wall 122 and is turned 90 degrees from the axis of the fan 120 to flow radially outward back into the room through louvers 117, 118 and 119 located in the cabinet 110 surrounding the space between the orifice plate 124 and the divider wall 122.

It is also possible, although not shown here, to provide louvers in the base 114 in the space between the orifice plate 124 and the divider wall 122 which would allow cooled air to be discharged down into the room. The fan 127 driven by the motor 121 mounted on the divider wall 122 is placed in an orifice 128 located in a plate 129. The orifice plate 129 along with the divider wall 122 are integrally part of the base 114 to form a chassis 136. The compressor 131 is mounted on the base 114. The inverted U-shaped condenser 130 is attached to the base 114 covering the compressor 131 and filling completely the space between the divider wall 122 and the orifice plate 129. The protective grill 113 which is integrally part of the cabinet 110 covers both sides and the top of the condenser 130. This arrangement of parts defines distinct inlet and outlet paths for air flowing through the fan 127. The fan 127 pulls outside air in through the protective grill 113 and through both sides and the top of the condenser 130. The air flows across the compressor 131 and the fan motor 121 providing cooling. After passing through the fan 127, the air is discharged outside.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A room air conditioner, comprising:

a compressor for compressing a refrigerant vapor;

a condenser connected to the compressor to receive the compressed vapor and to permit the compressed vapor to condense to a liquid thereby releasing heat energy to the condenser;

an evaporator connected to the condenser through an expansion device to receive the condensed liquid and to permit the condensed liquid to evaporate thereby removing heat energy from the evaporator;

a bottom base to support the compressor, the condenser and the evaporator;

a first air moving device situated to draw air axially inward in a first stream across the evaporator to permit heat to be removed from the stream;

a second air moving device for moving air in a second stream across the condenser to permit the second stream to remove heat from the condenser;

a divider wall attached to the base to separate the first stream from the second stream;

a housing comprising an interior section, a front grill, a top and two opposing sides, the interior section in combination with the first air moving device causing the first stream to flow axially through the evaporator which extends across an open front area and in substantial matching registry with the grill, against the divider wall and radially through air flow openings located in the top and both sides of the interior section to complete a first flow path for the first stream;

an exterior section comprising a top wall to enclose the compressor and the condenser and the second air moving device; and the first air moving device arranged to move the first stream inward through the grill and through the evaporator axially and radially outward through the air flow openings disposed in the side and top walls of the interior section of the housing.

2. An air conditioner according to claim 1, wherein the interior section of the housing is formed of a separate interior cabinet piece with air flow openings located in the top and the side walls of the interior cabinet; and the interior section is comprised of side walls and a rear wall defined by the condenser and a separate top cover.

3. An air conditioner according to claim 2, wherein the first air moving device is positioned in a front orifice plate behind the evaporator and is arranged to draw air axially in through the front grill across the evaporator and to discharge the air radially out through the air flow openings in the top and both sides of the interior cabinet.

4. An air conditioner according to claim 3, wherein the air flow openings in the top and both sides of the interior cabinet comprise louvers which direct the first air flow radially outward from the air conditioner as well as somewhat forward relative to the air conditioner.

5. An air conditioner according to claim 3, wherein the front orifice plate is integrally part of the interior cabinet and made from the same piece of material as the interior cabinet.

6. An air conditioner according to claim 1, wherein the interior section of the housing is integrally part of the front grill and made from the same material as the front grill and attaches to the divider wall.

7. An air conditioner according to claim 2, wherein the condenser is situated horizontally and comprises a U-shaped configuration supported on the base behind the divider wall with the condenser extending the full height from the base to the exterior top cover and extending back from the divider wall along both sides and across the rear face of the air conditioner.

8. An air conditioner according to claim 2, wherein the condenser defining the side walls and the rear wall of the exterior section of the housing is protected by a grill.

9. An air conditioner according to claim 7, wherein the U-shaped condenser is protected by a grill.

10. An air conditioner according to claim 7, wherein the second air moving device is positioned in a rear orifice plate which extends the full height from the base to the exterior top cover and the full width from one side to the other within the U-shaped condenser.

11. An air conditioner according to claim 10, wherein the second air moving device draws outside air in through both sides of the U-shaped condenser and discharges the air through the rear of the U-shaped condenser.

12. An air conditioner according to claim 10, wherein the second air moving device draws air in through the rear of the U-shaped condenser and discharges the air through at least one side of the U-shaped condenser.

13. An air conditioner according to claim 10, wherein the second air moving device also draws a small amount of air from openings on the exterior top cover.

14. An air conditioner according to claim 3, wherein the first air moving device is a motor-driven axial flow fan.

15. An air conditioner according to claim 13, wherein a single motor drives both the first and the second air moving devices.

16. An air conditioner according to claim 1, wherein the exterior top is situated slightly below the top of the interior cabinet to provide means for easy installation of the air conditioner.

17. A room air conditioner comprising:

a compressor for compressing a refrigerant vapor;

a condenser connected to the compressor to receive the compressed refrigerant vapor and to permit the compressed vapor to condense to a liquid thereby releasing heat energy to the condenser;

an evaporator connected to the condenser through an expansion device to receive the condensed liquid and to permit the liquid to evaporate thereby removing heat energy from the evaporator;

a bottom base to support the compressor, the condenser and the evaporator;

a first air moving device situated to draw air axially outward a first stream across the evaporator to permit heat to be removed from the first stream;

a second air moving device for moving air in a second stream across the condenser to permit the second stream to remove heat from the condenser;

a divider wall attached to the base to separate the first stream from the second stream;

a housing comprising an interior section, a front grill, a top and opposing side walls, the interior section in combination with the first air moving device causing the first stream to flow radially inward through air flow openings located on the top and side walls of the interior section, past the first air moving device and axially outward through the evaporator and front grill, the evaporator extending across an open front area in substantial matching registry with the front grill;

an exterior section comprised of side walls and a rear wall defined by the condenser and a top cover to enclose the compressor and the second air flow device; and the second air flow device situated inside the exterior section to move air both in and out through the condenser.

18. An air conditioner according to claim 17, wherein the condenser is situated horizontally in a U-shaped configuration supported on the base behind the divider wall with the condenser extending the full height from the base to the exterior top cover and extending back from the divider wall along both sides and across the rear face of the air conditioner.

19. An air conditioner according to claim 17, wherein the condenser defining the side walls and the rear wall of the exterior section of the housing is protected by a grill.

20. An air condition according to claim 18, wherein the U-shaped condenser is protected by a grill.

21. An air conditioner according to claim 20, wherein the second air moving device is positioned in a rear orifice plate which extends the full height from the base to the exterior top cover and the full width from one side to the other within the U-shaped condenser.

22. An air conditioner according to claim 20, wherein the second air moving device draws outside air in through both sides of the U-shaped condenser and discharges the air through the rear of the U-shaped condenser.

23. A room air conditioner comprising:

a compressor for compressing a refrigerant vapor;

a condenser connected to the compressor to receive the compressed refrigerant vapor and to permit the vapor to condense to a liquid thereby releasing heat energy to the condenser;

an evaporator connected to the condenser through an expansion device to receive the condensed liquid and to permit the liquid to evaporate thereby removing heat energy from the evaporator;

a chassis comprising a rear wall having a large rear orifice opening, a divider wall and a base attached to the two walls for holding the compressor, the evaporator and the condenser;

a first air moving device situated to draw air axially in a first stream through the evaporator to permit heat to be removed from the first stream;

a second air moving device for moving air in a second stream through the condenser to permit the second stream to remove heat from the condenser, the divider wall serving to separate the first stream from the second stream;

a housing comprising a top wall, two side walls and being secured to the chassis and to the rear wall of the chassis to form a top wall and two side walls of the room air conditioner and defining an open front area, the evaporator extending across the open front area, the housing further comprising a front portion disposed in front of the dividing wall to enclose the evaporator and the first air moving device and a rear portion disposed behind the dividing wall to enclose the compressor, the condenser and the second air moving device, the side walls having openings therethrough in the front and the rear portions thereof, the top wall having openings therethrough in the front and the rear portions thereof;

the front portion of the housing enclosing the evaporator with the open front area covered by a front grill serving as an axial air intake of the first stream across the evaporator surface, past the first air moving device and against the divider wall and with air flow openings located in the top and both sides of the front portion of the housing for radial air discharge from the divider wall and out the flow openings in the front portion of the housing.

24. An air conditioner according to claim 23, wherein the condenser is disposed vertically in an inverted U-shaped configuration supported on one base behind the divider wall with the condenser extending the full distance from the divider wall to the rear orifice wall.

25. An air conditioner according to claim 24, wherein the second air moving device is positioned in the rear orifice wall.

26. An air conditioner according to claim 25, wherein the second air moving device draws air in through both sides and the top of the inverted U-shaped condenser and discharges the air through the rear orifice wall.

27. An air conditioner according to claim 25, wherein the second air moving device draws air in through the rear orifice wall and discharges the air through both the sides and the top of the inverted U-shaped condenser.

28. An air conditioner according to claim 26, wherein the rear orifice wall is integrally part of the base and made from the same piece of material as the base.

29. An air conditioner according to claim 28, wherein the divider wall is integrally part of the base and made from the same piece material as the base.

30. An air conditioner according to claim 23, wherein the evaporator extends substantially across the entire open front area of the front portion of the housing.

31. An air conditioner according to claim 30, wherein the air flow openings in the top and both sides of the front portion of the housing comprises louvers which direct the first air flow radially outward from the air conditioner as well as somewhat forward relative to the air conditioner.

* * * * *